US010103014B2

(12) United States Patent
Newton

(10) Patent No.: US 10,103,014 B2
(45) Date of Patent: Oct. 16, 2018

(54) ION TRANSFER DEVICE FOR MASS SPECTROMETRY

(71) Applicant: Agilent Technologies, Inc., Santa Clara, CA (US)

(72) Inventor: Kenneth R. Newton, Concord, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 15/256,626

(22) Filed: Sep. 5, 2016

(65) Prior Publication Data

US 2018/0068840 A1 Mar. 8, 2018

(51) Int. Cl.

| | |
|---|---|
| ***H01J 49/04*** | (2006.01) |
| ***H01J 49/14*** | (2006.01) |
| ***H01J 49/24*** | (2006.01) |

(52) U.S. Cl.

CPC ..... *H01J 49/0404* (2013.01); *H01J 49/145* (2013.01); *H01J 49/24* (2013.01)

(58) Field of Classification Search

CPC .... H01J 49/04; H01J 49/0404; H01J 49/0431; H01J 49/0445; H01J 49/145; H01J 49/147; H01J 49/165; H01J 49/24; H01J 49/26

See application file for complete search history.

(56) References Cited

U.S. PATENT DOCUMENTS

| | | | | |
|---|---|---|---|---|
| 6,380,538 | B1 * | 4/2002 | Bajic | H01J 49/10 250/281 |
| 6,455,846 | B1 | 9/2002 | Prior et al. | |
| 6,486,469 | B1 * | 11/2002 | Fischer | H01J 49/04 250/281 |
| 6,667,474 | B1 | 12/2003 | Abramson et al. | |
| 6,777,672 | B1 | 8/2004 | Park | |
| 7,470,899 | B2 | 12/2008 | Atherton et al. | |
| 7,838,826 | B1 * | 11/2010 | Park | G01N 27/622 250/281 |
| 9,048,079 | B2 | 6/2015 | Krutchinsky et al. | |
| 9,972,482 | B2 * | 5/2018 | Hendrikse | H01J 49/168 |
| 2005/0079137 | A1 * | 4/2005 | Blondino | A61K 9/007 424/45 |
| 2006/0108539 | A1 | 5/2006 | Franzen | |
| 2008/0142698 | A1 * | 6/2008 | Atherton | H01J 49/0404 250/282 |

(Continued)

FOREIGN PATENT DOCUMENTS

EP 1364387 B1 1/2016

OTHER PUBLICATIONS

Extended European Search Report issued in counterpart EP Application No. 17189166.6 dated Dec. 6, 2017 (nine (9) pages).

*Primary Examiner* — David E Smith

(57) ABSTRACT

An ion transfer device for transferring ions from one chamber to another, reduced-pressure chamber includes an inlet section and a main capillary section. The inlet section has a lumen and the main capillary section has a bore communicating with the lumen. The inside diameter of the lumen is less than that of the bore. The inlet section may be removable from an installation site separately from the main capillary section. The ion transfer device may be utilized, for example, in an atmospheric-pressure interface of a mass spectrometer.

20 Claims, 9 Drawing Sheets

(56) References Cited

U.S. PATENT DOCUMENTS

| | | | | |
|---|---|---|---|---|
| 2009/0212210 | A1* | 8/2009 | Finlay | H01J 49/0404 250/288 |
| 2010/0276584 | A1* | 11/2010 | Splendore | H01J 49/0404 250/282 |

* cited by examiner

ION TRANSFER DEVICE FOR MASS SPECTROMETRY

TECHNICAL FIELD

The present invention relates generally to an ion transfer device useful for transferring ions from an ion source into a mass spectrometer, particularly as may be utilized in an atmospheric-pressure interface.

BACKGROUND

In the process of analyzing a sample by mass spectrometry (MS), the MS system first ionizes the sample to create analyte ions. The MS system then transfers the ions into a mass analyzer, and the mass analyzer resolves the ions on the basis of the ions' differing mass-to-charge (m/z) ratios. An ion detector measures the abundance of the ions at each m/z ratio detected. The MS system then processes signals outputted by the ion detector to generate mass (m/z) spectra that provide quantitative and qualitative information regarding the components of the sample (e.g., compounds, isomers, elements, etc.).

The mass analyzer operates in a controlled high-vacuum environment, for example at $10^{-6}$ to $10^{-9}$ Torr. In some MS systems, the ion source (where ionization of the sample is performed) also operates at a vacuum pressure. In other MS systems, such as when coupled to a liquid chromatography (LC) instrument (an LC-MS system), the ion source operates at or around atmospheric pressure. An MS system utilizing an atmospheric pressure ionization (API) source requires an interface between the API source and the evacuated regions of the MS system in which the mass analyzer and other devices are located. The interface needs to effectively isolate the atmospheric-pressure region where the ions are created from the evacuated regions where the ions are processed, while at the same time provide a way to efficiently transport the ions into the evacuated regions after they are created.

A capillary tube is often utilized to transfer the ions from the API source into the first vacuum region of the MS system. The capillary tube has a small inside bore, the inside diameter of which may range from a fraction of a millimeter (mm) to a few millimeters. The capillary tube extends through the boundary between the API source and the first vacuum region, whereby the tube's entrance is exposed to the ionization region of the API source and the tube's exit is exposed to the first vacuum region. Ions and gas in the API source are drawn into the tube's entrance, transported through the tube's bore, and emitted from the tube's exit into the first vacuum region. Ion optics guide the ions further into the MS system and ultimately to the mass analyzer. The capillary tube may be metal. Alternatively, the capillary tube may be glass with an electrically resistive property (coating or bulk resistance) to allow the tube's entrance to be placed at a relatively high voltage level while the tube's exit is maintained at a relatively low voltage level. In this case, the ions are effectively transported through the tube's bore because the gas drag forces on the ions in the capillary tube greatly exceed the ion mobility (electric) forces on the ions in the presence of the internal electric field in the capillary tube.

However, the capillary tube has a tendency to become contaminated after extended use, such as may be due to ion diffusion and space-charge repulsion, and thus periodically requires cleaning or even replacement. It has also been found that the majority of the contamination is within the first 3-10 mm of the length of the capillary tube, i.e., at its entrance end. Cleaning or replacement requires access to the capillary tube, which often requires breaking the vacuum maintained by the MS system. Hence, cleaning or replacing a contaminated capillary tube can require significant downtime in the operation of the MS system.

Therefore, there is a need for capillary-based ion transfer devices that more effectively address the problem of contamination. There is also a need for capillary-based ion transfer devices that provide improved evaporation of droplets and desolvation of the ions from the droplets. There is also a need for capillary-based ion transfer devices that allow careful control over the supersonic expansion occurring at the vacuum interface to reduce the associated cooling of the gas jet and potential for ion clustering. Reducing the exit velocity into the vacuum may also assist in creating a more stable gas flow in the vacuum chamber and more stable signal levels. There is also a need for capillary-based ion transfer devices having capillary entrance geometries at the higher-pressure side of the interface that are modified so as to change the gas flow near the capillary entrance and/or change the electric field shape at that location in a manner that improves ion capture and transmission and reduce contamination.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, an ion transfer device includes: an ion inlet section comprising a lumen having a lumen inside diameter, the lumen comprising a lumen inlet; a main capillary section comprising a bore having a bore inside diameter, the bore comprising a bore outlet, wherein: the ion inlet section and the main capillary section are positioned adjacent to each other such that the lumen communicates with the bore, and the ion inlet section and the main capillary section define an ion transfer path running from the lumen inlet to the bore outlet; and the lumen inside diameter is less than the bore inside diameter.

According to another embodiment, an ion transfer system includes: a first chamber; a second chamber configured to be evacuated down to a pressure lower than a pressure of the first chamber; a wall separating the first chamber and the second chamber, the wall having a thickness and comprises an opening extending through the thickness; and the ion transfer device of claim 1, wherein the ion transfer device is positioned at the wall in a fluid-sealed manner, at least one of the ion inlet section and the main capillary section extends into the opening, the lumen inlet communicates with the first chamber, and the bore outlet communicates with the second chamber.

According to another embodiment, a mass spectrometry (MS) system includes: an ion transfer system according to any of the embodiments disclosed herein; an atmospheric-pressure ionization device configured for producing ions in the first chamber; a vacuum housing enclosing the second chamber; and a mass analyzer disposed in the vacuum housing.

According to another embodiment, a method for transferring ions includes: creating a pressure differential between a first chamber and a second chamber such that the first chamber has a pressure and the second chamber has a pressure less than the pressure of the first chamber, wherein:

the first chamber and the second chamber are separated by a wall; and an ion transfer device extends through the wall and comprises an ion inlet section and a main capillary section; the ion inlet section comprises an inlet leading to a lumen; the main capillary section comprises a bore communicating with the lumen and leading to an outlet; and the lumen has a lumen diameter and the bore has a bore diameter greater than the lumen diameter; drawing the ions into the inlet; transporting the ions from the inlet through the lumen and into the bore, and through the bore to the outlet; and emitting the ions from the outlet into the second chamber.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

As used herein, the term "atmospheric pressure" is not limited to exactly 760 Torr, or one atmosphere (1 atm), but instead generally encompasses a range around 760 Torr (e.g., 100 to 900 Torr).

As used herein, the term "vacuum" or "vacuum pressure" generally refers to a pressure that is at least an order of magnitude less than atmospheric pressure. For example, vacuum pressure may encompass sub-atmospheric pressures down to $10^{-9}$ Torr or lower.

As appreciated by persons skilled in the art, different types of vacuum pumps may be utilized to bring an enclosed space, or vacuum chamber, down to different ranges of pressure. For example, a "roughing" pump (or "backing" pump) may be utilized to pump a vacuum chamber down to a "rough" vacuum level of, for example, down to about $10^{-3}$ Torr. Roughing pumps typically have a predominantly mechanical design, examples of which include, but are not limited to, scroll pumps, rotary vane pumps, diaphragm pumps, Roots blower (positive displacement lobe) pumps, etc. High-vacuum pumps are utilized to achieve higher levels of vacuum (lower pressures), for example down to $10^{-9}$ Torr or lower. Examples of high-vacuum pumps include, but are not limited to, turbomolecular pumps and sputter-ion pumps. A roughing pump may be utilized in conjunction with a high-vacuum pump as a first stage of vacuum pump-down and/or to isolate a high-vacuum pump from rough-vacuum or higher-pressure environments.

Figure 1:
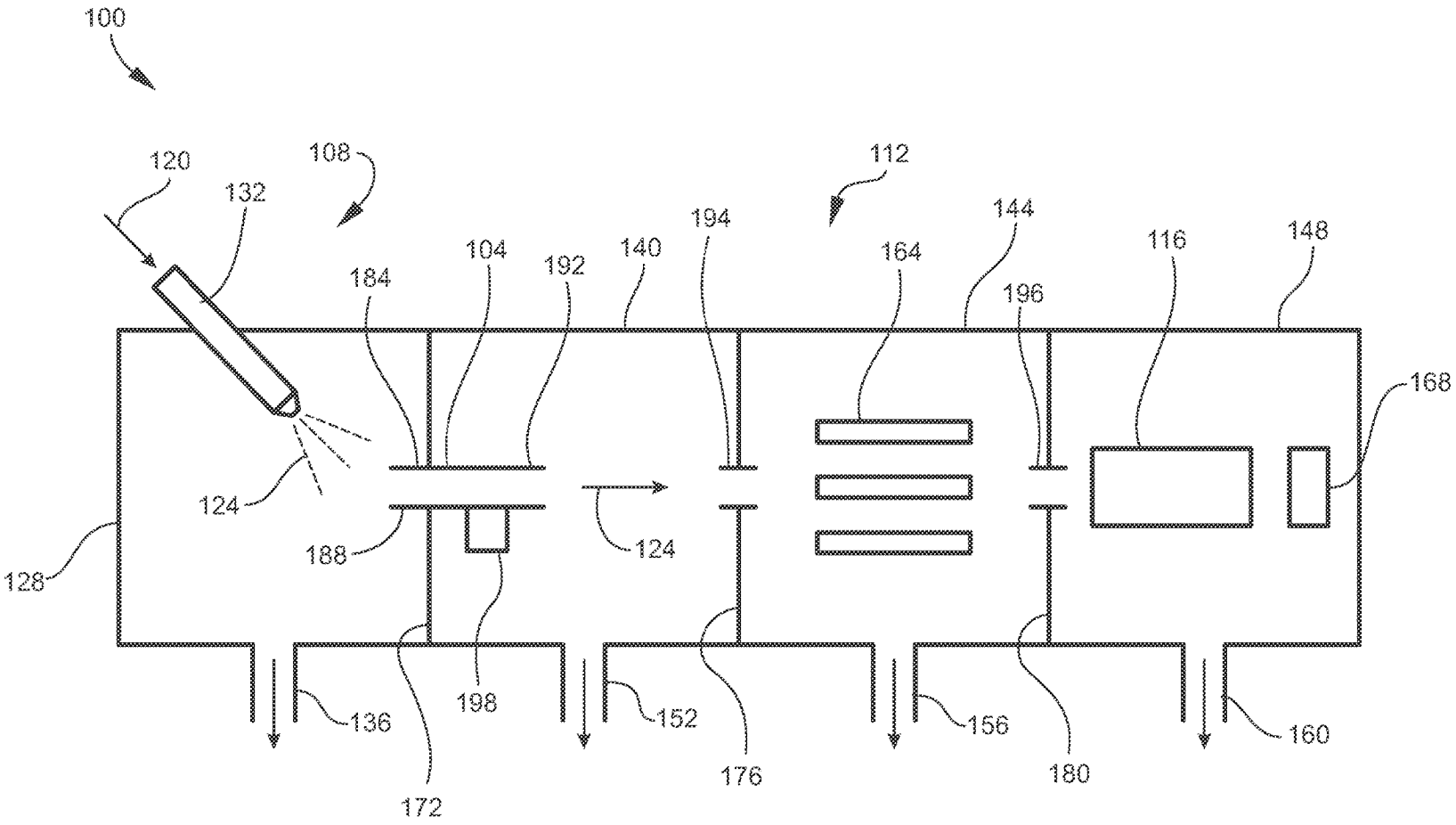
FIG. 1 is a schematic view of an example of a mass spectrometry (MS) system in which an ion transfer device as presently disclosed herein may be provided according to an embodiment.

FIG. 1 is a schematic view of an example of a mass spectrometry (MS) system 100 in which an ion transfer device 104 as presently disclosed herein may be provided according to an embodiment. An MS system is but one non-exclusive example of an operating environment for the ion transfer device 104. More generally, the ion transfer device 104 may be utilized in any system in which ions are transferred from a region held at a relatively high pressure (e.g., atmospheric pressure) to another region held at a relatively lower pressure (e.g., vacuum pressure). Different types of MS systems, their operating principles, and their components are generally known to persons skilled in the art. Therefore, the example of the MS system 100 illustrated in FIG. 1 is described herein only briefly to provide a context for the presently disclosed ion transfer device 104.

In the illustrated example, the MS system 100 includes an atmospheric-pressure ionization (API) source 108 interfaced with a vacuum housing 112 in which a mass analyzer 116 and other ion processing components are located. Accordingly, the API source 108 is configured to ionize a sample 120 generally at atmospheric pressure, whereas the mass analyzer 116 is required to operate at high vacuum (very low pressure) in the usual manner. The ion transfer device 104 provides a path for ions 124 and neutral gas molecules (or atoms) to pass from the API source 108 into the vacuum housing 112, as described further below.

The API source 108 includes a first chamber 128, which in the present embodiment is an ionization chamber in which ions 124 are produced from a sample 120. The API source 108 also includes an API ionization device 132, which may be any device capable of ionizing a sample 120 at atmospheric pressure. Examples of API ionization devices include, but are not limited to, spray-type devices (electrospray ionization (ESI) devices, thermospray ionization devices, etc.), atmospheric-pressure chemical ionization (APCI) devices, atmospheric-pressure photoionization (APPI) devices, atmospheric-pressure laser desorption ionization (AP-LDI) devices, atmospheric-pressure matrix-assisted laser desorption ionization (AP-MALDI) devices, etc. Thus, depending on the embodiment, the ions 124 schematically depicted in FIG. 1 may be representative of an effluent from the API ionization device 132 that includes, in addition to the ions 124, droplets containing analytes and non-analytical matrix materials that can be evaporated to produce more ions, and gas molecules or atoms utilized to nebulize the sample 120 and/or carry the sample 120 to the API ionization device 132. Depending on the type of API ionization device 132 utilized, the sample 120 may be initially provided in the form of a fluid or a solid. For example, the sample 120 may be flowed to or into the API ionization device 132 from a sample source. In some embodiments, the sample source may be the output of a liquid chromatography (LC) instrument or other type of analytical separation instrument. As another example, the sample 120 may be provided on a solid target surface and desorbed from the surface by the API ionization device 132. The API source 108 may further include an exhaust port 136 through which gases and vapors may be removed from the first chamber 128 during the ionization process.

The vacuum housing 112 includes one or more vacuum chambers as necessary for pumping the MS system 100 down to the very low pressure (high vacuum) required for operating the mass analyzer 116, and for containing intermediate devices utilized for performing operations on the ions 124 prior to final mass analysis by the mass analyzer 116. In the illustrated example, the vacuum housing 112 includes a second chamber 140, a third chamber 144, and a fourth chamber 148, with the understanding that less or more vacuum chambers may be provided depending on the embodiment. The chambers 140, 144, and 148 include respective ports 152, 156, and 160 communicating with a vacuum system (schematically represented by downward arrows), which is configured for maintaining a specific level of vacuum in each of the chambers 140, 144, and 148. Typically, the chambers 140, 144, and 148 are held (maintained by the vacuum system) at successively lower pressures, with the final (third) chamber 144 enclosing the mass analyzer 116 being held at the lowest pressure (highest vacuum) obtained by the MS system 100.

In the illustrated example an ion guide 164 is disposed in the third chamber 144, and the mass analyzer 116 and an ion detector 168 are disposed in the fourth chamber 148. The ion guide 164 may be of any type such as, for example, a linear multipole ion guide (as schematically illustrated), an ion funnel, a collision cell, a mass filter or other type of mass analyzer, etc. The mass analyzer 116 may be of any type such as, for example, a quadrupole mass analyzer, a time-of-flight (TOF) analyzer, an ion cyclotron resonance (ICR) cell, a magnetic sector, an electric sector, an electrostatic ion trap, etc. The ion detector 168 may be of any type such as, for example, an electron multiplier, a photomultiplier, a Faraday cup, etc. Many other types of ion optics may be included in the chambers 128, 140, 144, and 148, as needed for the intended use and operation of the MS system 100, as appreciated by persons skilled in the art.

Adjacent chambers 128, 140, 144, and 148 are separated by respective walls 172, 176, and 180. The ion transfer device 104 extends into or through an opening 184 formed through the thickness of the wall 172, such that an inlet 188 of the ion transfer device 104 communicates with the first chamber 128 and an outlet 192 of the ion transfer device 104 communicates with the second chamber 140. The ion transfer device 104 is mounted to the wall 172 in a fluid-tight manner, whereby the interior passage of the ion transfer device 104 provides the sole path for ions to travel from the API source 108 into the vacuum housing 112. The ion transfer device 104 is configured to serve as a gas conductance barrier that limits the flow of gas through the ion transfer device 104 and effectively maintains a pressure differential between the atmospheric-pressure first chamber 128 and the sub-atmospheric-pressure second chamber 140. Other walls (e.g., walls 176 and 180) separating adjacent chambers include openings (e.g., openings 194 and 196) that may function as gas conductance barriers, skimmer cones, ion optics, etc.

Ions and gas flow through the ion transfer device 104 under the influence of the pressure differential between the first chamber 128 and the second chamber 140. In some embodiments, the ion transfer device 104 includes electrodes (e.g., electrically conductive or electrically resistive elements) at its inlet end and outlet end. A voltage imparted between these electrodes generates an electric field that urges the ions through the ion transfer device 104. In some embodiments, the ion transfer device 104 includes a heating device 198 to promote evaporation of droplets and desolvation of ions while the ions and droplets travel through the ion transfer device 104.

More detailed examples of embodiments of the ion transfer device 104 are described below with reference to FIGS. 2-9. These embodiments may improve ion transmission from a relatively high-pressure environment (e.g. an atmospheric-pressure environment, such as the API source 108 described above and illustrated in FIG. 1) into a lower-pressure (reduced-pressure) environment (e.g. a vacuum environment, such as the vacuum housing 112 described above and illustrated in FIG. 1), with reduced contamination. In some embodiments, such as those illustrated in FIGS. 2-8, an inlet end portion of the ion transfer device 104 is removable. The removable inlet end portion, also referred to an ion inlet section or structure, has a length along which most or all of the contamination is expected to occur. Therefore, removing contamination from ion transfer device 104 requires only removing the inlet end portion for cleaning or replacement, while the remaining portion of the ion transfer device 104 can remain installed. Moreover, the ion transfer device 104 may be configured such that removal of the inlet end portion does not require shutting down or changing the operating parameters of the vacuum system of the instrument in which the ion transfer device 104 is installed (e.g., an MS system 100 as generally described above and illustrated in FIG. 1). Thus, such embodiments may minimize the reduction in instrument sample throughput caused by the process of removing contamination in the ion transfer device 104.

Figure 2:
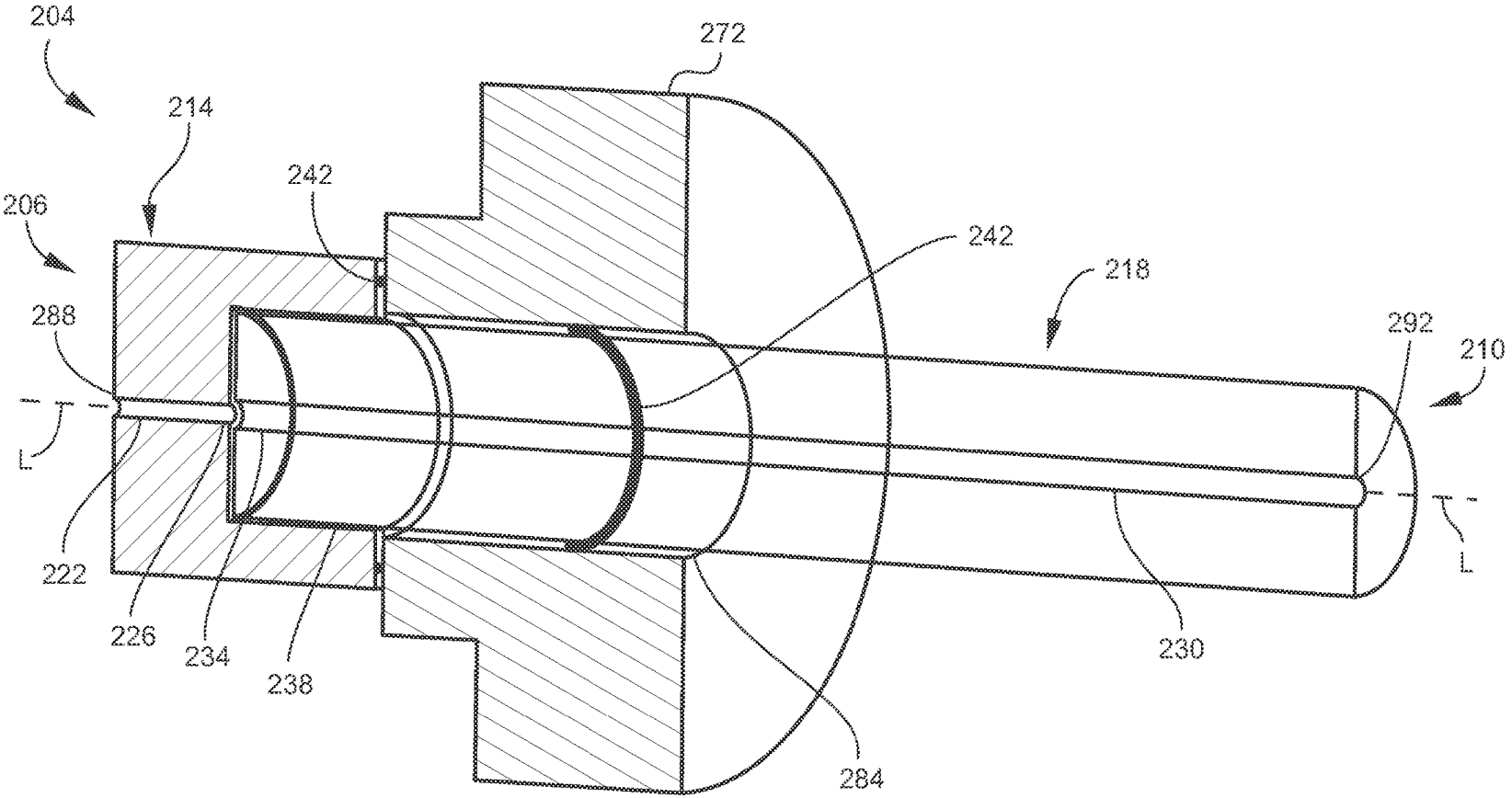
FIG. 2 is a cross-sectional schematic perspective view of an example of an ion transfer device according to an embodiment.

FIG. 2 is a cross-sectional schematic perspective view of an example of an ion transfer device 204 according to an embodiment. Generally, the ion transfer device 204 has a length along a longitudinal axis L, and includes an inlet end 206 and an axially opposite outlet end 210. When installed in an associated instrument (e.g., the MS system 100 illustrated in FIG. 1), the inlet end 206 is disposed in or faces a first chamber (e.g., the first chamber 128 illustrated in FIG. 1) and the outlet end 210 is disposed in or faces a second chamber (e.g., the second chamber 140 illustrated in FIG. 1), which is separated from the first chamber by a wall 272. In a typical use of the ion transfer device 204, the second chamber is maintained at a pressure lower than the first chamber. For example, the first chamber may be at (or around) atmospheric pressure while the second chamber is at vacuum pressure, as described above.

The ion transfer device 204 includes an ion inlet section (or inlet end portion) 214 at the inlet end 206 and a main capillary section 218 extending along the longitudinal axis L from the ion inlet section 214 to the outlet end 210. One or both of the ion inlet section 214 and the main capillary section 218 may extend into an opening 284 extending through the thickness of the wall 272, or one of the ion inlet section 214 and the main capillary section 218 (as in the illustrated embodiment) may extend completely through the opening 284. The ion inlet section 214 includes a lumen 222 (or first lumen, or first bore) formed through the solid portion (body) of the ion inlet section 214. The lumen 222 extends along the longitudinal axis L from a lumen inlet 288 to a lumen outlet 226. The main capillary section 218 includes a capillary bore 230 (or second bore, or second lumen) formed through the solid portion (body) of the main capillary section 218. The capillary bore 230 extends along the longitudinal axis L from a bore inlet 234 to a bore outlet 292. The ion inlet section 214 and the main capillary section 218 are positioned adjacent to each other such that the lumen outlet 226 communicates with the bore inlet 234, and the lumen outlet 226 and the bore inlet 234 face each other in alignment along the longitudinal axis L.

In some embodiments, the ion inlet section 214 is removable from the main capillary section 218, as described further below. In other embodiments, the ion inlet section 214 is integrally formed with the main capillary section 218 as a single-piece construction, or is otherwise integrally adjoined to the main capillary section 218 in a non-removable manner such as by adhesion, bonding, fusing, welding, etc. In either case, the ion inlet section 214 and the main capillary section 218 define an ion transfer path running from the lumen inlet 288 to the bore outlet 292. The lumen inlet 288 defines the inlet or entrance of the ion transfer device 204, the bore outlet 292 defines the outlet or exit of the ion transfer device 204, and the lumen 222 and capillary bore 230 cooperatively define the overall internal passage of the ion transfer device 204. When installed in an associated instrument, ions and gas in the first chamber are drawn into the lumen inlet 288, travel through the lumen 222 and the capillary bore 230, and are emitted from the bore outlet 292 into the second chamber. In some embodiments, the overall geometry of the ion transfer device 204 may be considered as being that of a capillary tube, with the ion inlet section 214 being either removable from the main capillary section 218 or integral to the main capillary section 218, as described further below.

As illustrated, the inside diameter of the lumen 222 is less than the inside diameter of the capillary bore 230. By this configuration, the inside diameter of the internal passage increases at (at least) one point along the longitudinal axis L. In the present embodiment, the inside diameter increases at the interface of the ion inlet section 214 (lumen outlet 226) and the main capillary section 218 (bore inlet 234). This configuration allows the gas to accelerate as high as the speed of sound at the location where the inside diameter increases. The gas flow speed at the lumen inlet 288 is also increased significantly. This increased gas flow speed serves to entrain ions from a larger region in front of the ion transfer device 204 in the first chamber. Moreover, due to the increased gas flow speed, the charge density of the ions inside the ion transfer device 204 is reduced and the residence time of the ions inside the ion transfer device 204 is also reduced. As a result of this configuration and the flow behavior enabled thereby, contamination by ions and neutral particles in the ion transfer device 204 (in both the ion inlet section 214 and the main capillary section 218) may be reduced.

In some embodiments, the inside diameter of the lumen 222 and/or the inside diameter of the capillary bore 230 may be constant along their respective lengths. In other embodiments, the inside diameter of the lumen 222 and/or the inside diameter of the capillary bore 230 may vary gradually or in one or more steps along their respective lengths. In an embodiment where an inside diameter varies, the maximum value or the average value of the inside diameter may serve as the basis for comparing the inside diameters of the lumen 222 and the capillary bore 230. Thus, the maximum value of the inside diameter of the lumen 222 may be less than the maximum value of the inside diameter of the capillary bore 230. Alternatively, the average value of the inside diameter of the lumen 222 along its length may be less than the average value of the inside diameter of the capillary bore 230 along its length.

In typical implementations of the ion transfer device 204 (e.g., typical fluid flow rates and pressures), the inside diameters of the lumen 222 and the capillary bore 230 are in a range from a fraction of a millimeter to a few millimeters. As one non-limiting example, the inside diameter of the lumen 222 may be in a range from 0.25 mm to 0.6 mm, and the inside diameter of the capillary bore 230 may be in a range from 0.5 mm to 1.0 mm. Generally, the overall axial length of the ion transfer device 204 from the lumen inlet 288 to the bore outlet 292 is set to be sufficient for providing an ion transfer path through the wall 272, and to allow a sufficient amount of ion desolvation and droplet evaporation to occur. Also, the axial length may be adjusted so that, in conjunction with the inside diameter(s), the conductance of the ion transfer device 204 matches the available pumping speed provided for the first vacuum chamber. Typically, the length of the ion transfer device 204 is on the order of tens to a few hundreds of millimeters, for example 90 mm or 180 mm.

The inlet end or face of the ion inlet section 214 that surrounds the lumen inlet 288 may have a blunt geometry, as illustrated. Alternatively, the inlet end or face of the ion inlet section 214 may have a sharper or more pointed shape in which an outside diameter of the ion inlet section 214 increases in the direction toward the main capillary section 218. A more pointed geometry may assist in directing the gas flow near the lumen inlet 288 in a way that will increase ion transmission and reduce contamination. Moreover, a more pointed geometry may create a higher (inward) radial electric field that helps to direct ions toward the entrance of the ion transfer device 204 (lumen inlet 288). In addition, if the interface provides a counter-flow of drying gas in this part of the system, the pointed shape may also increase the (inward) radial component of gas velocity in the same location. The combination of the two effects may increase ion transmission from the region in front of the lumen inlet 288 into the lumen 222. By directing more ions into the lumen 222, fewer ions (and droplets) are deposited on the front surface of the ion inlet section 214, reducing the contamination effects there.

In some embodiments and as illustrated, the ion inlet section 214 and the main capillary section 218 are physically separate components. This enables the ion inlet section 214 to be removable from the operating site without having to also remove the main capillary section 218. Thus the ion inlet section 214, as a separate component, may be easily cleaned or replaced without having to also clean or replace the main capillary section 218. As noted above, in many applications most of the contamination occurs within the inlet end region (e.g., the first 3-10 mm of axial length) of an ion transfer device. Accordingly, removing only the ion inlet section 214 may be all that is needed to remove most or all of the contamination from the internal passage of the ion transfer device 204. Hence, the axial length of the ion inlet section 214 may be less than the axial length of the main capillary section 218, and may be sufficient to span the length over which most or all of the contamination is expected to occur. As a non-limiting example, the axial length of the ion inlet section 214 may be in a range from 3-10 mm. With the length of the ion inlet section 214 being a small portion of the full length of the internal passage of the ion inlet section 214, the main capillary section 218 can be designed to have a gas conductance that remains sufficiently low to maintain a pressure differential between the first chamber and the reduced-pressure second chamber. Consequently, in the absence of the ion inlet section 214, any resulting increase in the gas conductance of the ion transfer device 204 is limited enough that the ion inlet section 214 may be removed without needing to shut down the vacuum system, which is advantageous as noted above.

In some embodiments and as illustrated, the ion inlet section 214 when configured as a separate component may be configured so as to be removably engaged with the main capillary section 218. In the illustrated embodiment, the ion inlet section 214 is configured as an end cap. In such configuration, the lumen 222 transitions to a larger-diameter recess or socket 238. The recess 238 is large enough to receive the inlet end of the main capillary section 218. In the embodiment specifically illustrated in FIG. 2, the ion inlet section 214 is adjacent to the higher-pressure side of the wall 272, and the main capillary section 218 extends through the opening 284 of the wall 272 and into the recess 238 of the ion inlet section 214. The end-cap geometry of the ion inlet section 214 may be characterized as including a lumen section through which the lumen 222 extends, and an adjoining sleeve section through which the recess 238 extends and into which the main capillary section 218 is inserted.

The ion inlet section 214 and the main capillary section 218 may be fixed in position relative to each other and to the wall 272 by any suitable means. The ion inlet section 214 and the main capillary section 218 may be attached to each other, and/or one or both of the ion inlet section 214 and the main capillary section 218 may be attached to the wall 272, by utilizing appropriate mounting components (not shown). The ion transfer device 204 may be positioned in the opening 284 of the wall 272, and the ion inlet section 214 and the main capillary section 218 may be positioned adjacent to each other such that the lumen outlet 226 communicates with the bore inlet 234, in a fluid-sealed or substantially fluid-sealed manner by providing one or more sealing interfaces. In the illustrated embodiment, for example, sealing elements (e.g., O-rings) 242 may be positioned in an annular gap in the opening 284 between the main capillary section 218 and the wall 272, and in the axial gap between the ion inlet section 214 and the wall 272.

Generally, the ion inlet section 214 and the main capillary section 218 may be composed of electrically conductive materials (e.g., metals, metal alloys, conductive plastics, etc.) or electrically insulating materials (e.g., glass, fused silica, other ceramics, metal oxides, metal nitrides, polymers, etc.). As noted above, it may be desirable to generate an axial electrical field across the length of the ion transfer device 204 by coupling voltage sources to the ion inlet section 214 at or near the inlet end and the outlet end. For this purpose, the ion inlet section 214 and the main capillary section 218 if composed of insulating materials may include outer conductive coatings or electrically resistive coatings serving as electrodes (conductive or resistive elements) on the outer surfaces of the ion inlet section 214 and the main capillary section 218. A resistive coating may be formed, for example, from a resistive ink such as a carbon ink, cermet ink, metallic ink, conductive plastic ink, or polymer ink, as further described in U.S. Pat. No. 7,064,322, the entire contents of which are incorporated by reference herein. Alternatively, the insulating material utilized may have a bulk resistance that enables generation of an electric field in response to application of voltages.

In some embodiments, one of the ion inlet section 214 and the main capillary section 218 may be composed of an electrically conductive material while the other is composed of an electrically insulating material. For example, the ion inlet section 214 may be composed of a metallic material (metal or metal alloy) and the main capillary section 218 may be composed of a glass. Utilizing a metallic material may facilitate the fabrication of the features of the ion inlet section 214. When composed of a glass or other insulating material, the main capillary section 218 may include a first conductive or resistive element proximate to the bore inlet 234 and a second resistive element proximate to the bore outlet 292, such that the first resistive element and the second resistive element are independently addressable by respective voltage sources. The first resistive element may be electrically interconnected to the ion inlet section 214.

The main capillary section 218 may be a monolithic structure as illustrated. Alternatively, the main capillary section 218 may be axially divided along its length so as to include a plurality of tube segments serially positioned adjacent to each other in a fluid-sealed or substantially fluid-sealed manner, such as by providing a surrounding sleeve and sealing elements as necessary. Providing the main capillary section 218 in segmented form may be based on manufacturing considerations, such as the tube material, aspect ratio (length to diameter), bore geometry, etc. Tube segments are independently addressable by respective voltage sources, which enables the application of a highly controlled axial voltage gradient if desired.

In the embodiment illustrated in FIG. 2, the inside diameters of the lumen 222 and the capillary bore 230 are constant along their axial lengths, i.e., the lumen 222 and the capillary bore 230 are shaped as straight cylinders. In this case, the inside diameter of the overall internal passage of the ion transfer device 204 is increased (e.g., stepped up) just once, namely at the transition from the lumen 222 to the capillary bore 230. As noted above, the gas may accelerate to the speed of sound at this transition. In the embodiment specifically illustrated in FIG. 2, the inside diameter of the lumen 222 is only slightly smaller than that of the capillary bore 230. With this configuration, there may be only one supersonic expansion at the bore outlet 292. The capillary bore 230 may be sized to limit gas conductance and flow to a safe operating range that allows the ion inlet section 214 to be removed without needing to shut down the vacuum system.

Figure 3:
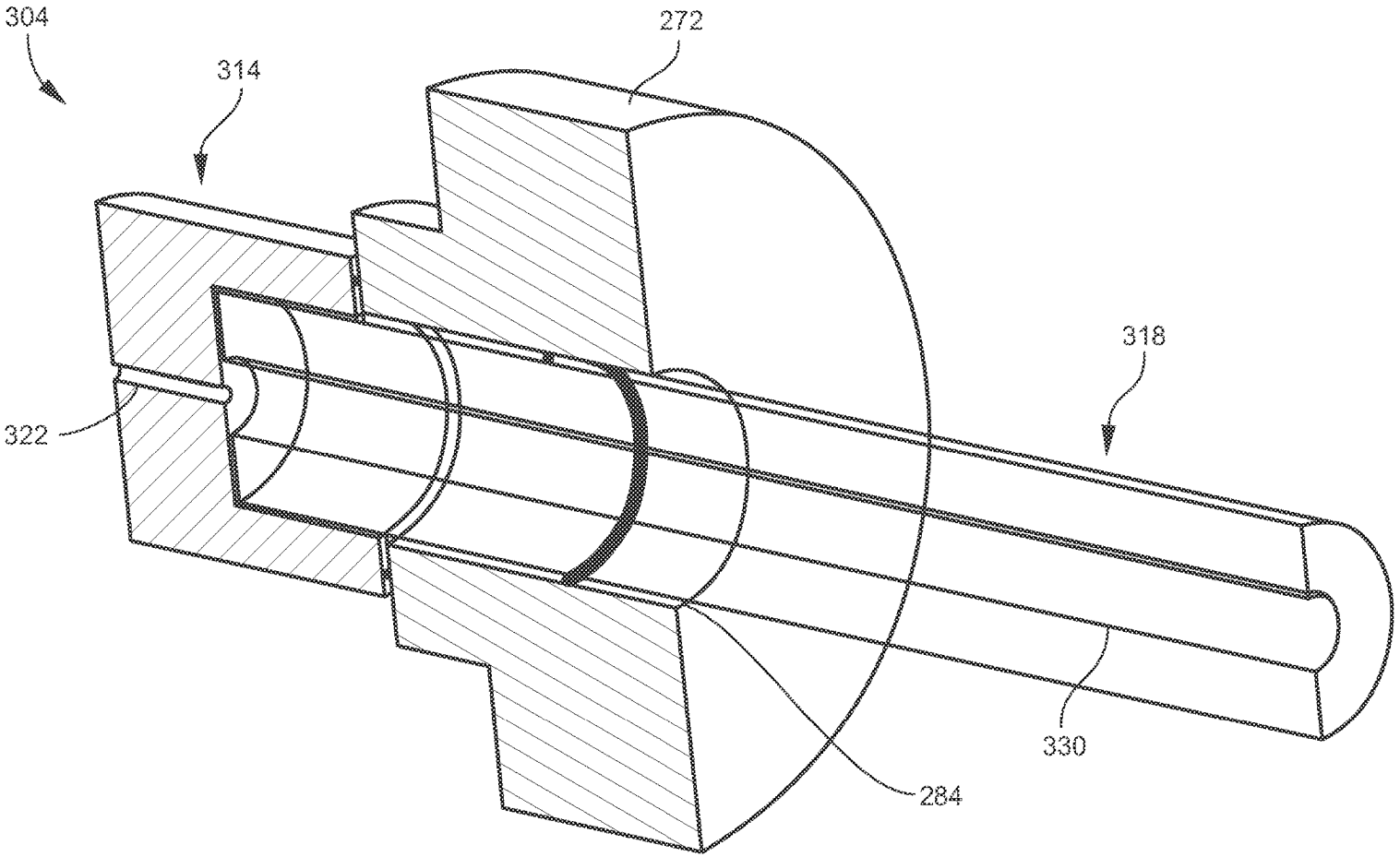
FIG. 3 is a cross-sectional schematic perspective view of an example of an ion transfer device according to another embodiment.

FIG. 3 is a cross-sectional schematic perspective view of an example of an ion transfer device 304 according to another embodiment. Like the ion transfer device 204 of FIG. 2, the ion transfer device 304 includes an ion inlet section 314 having a lumen 322 positioned adjacent to a main capillary section 318 having a capillary bore 330 communicating with the lumen 322, with the capillary bore 330 having a larger inside diameter than that of the lumen 322. The ion transfer device 304 differs in that its capillary bore 330 is much larger than the capillary bore 230 of the ion transfer device 204 of FIG. 2. Additionally, the difference between the inside diameters of the capillary bore 330 and the lumen 322 of the ion transfer device 304 is much larger than the difference between the inside diameters of the lumen 222 and the capillary bore 230 of the ion transfer device 204 of FIG. 2. The respective inside diameters of the lumen 322 in the embodiment of FIG. 3 and the lumen 222 in the embodiment of FIG. 2 may be the same, substantially the same, or different (with the lumen in either embodiment being larger or smaller than the other). With the configuration of the ion transfer device 304 of FIG. 3, most of the pressure drop and expansion of the gas may occur in the lumen 322. In this case, the gas flow may become fully supersonic downstream from the transition from the lumen 322 to the capillary bore 330, and may or may not be supersonic upon exiting the ion transfer device 304 into the main vacuum environment (e.g., second chamber). In some embodiments, the inside diameter of the capillary bore 330 may be so large as to not provide any significant conductance limit for the gas flow after removing the ion inlet section 314. In such case, however, the main capillary section 318 with the comparatively larger capillary bore 330 may function as an effective transfer tube that allows ions sufficient time to be fully desolvated by the time of exiting into the main vacuum environment. Moreover, as in other embodiments, the main capillary section 318 optionally may be heated to promote evaporation of droplets. The ion transfer device 304 in other aspects may be configured the same as or similar to the ion transfer device 204 of FIG. 2.

Figure 4:
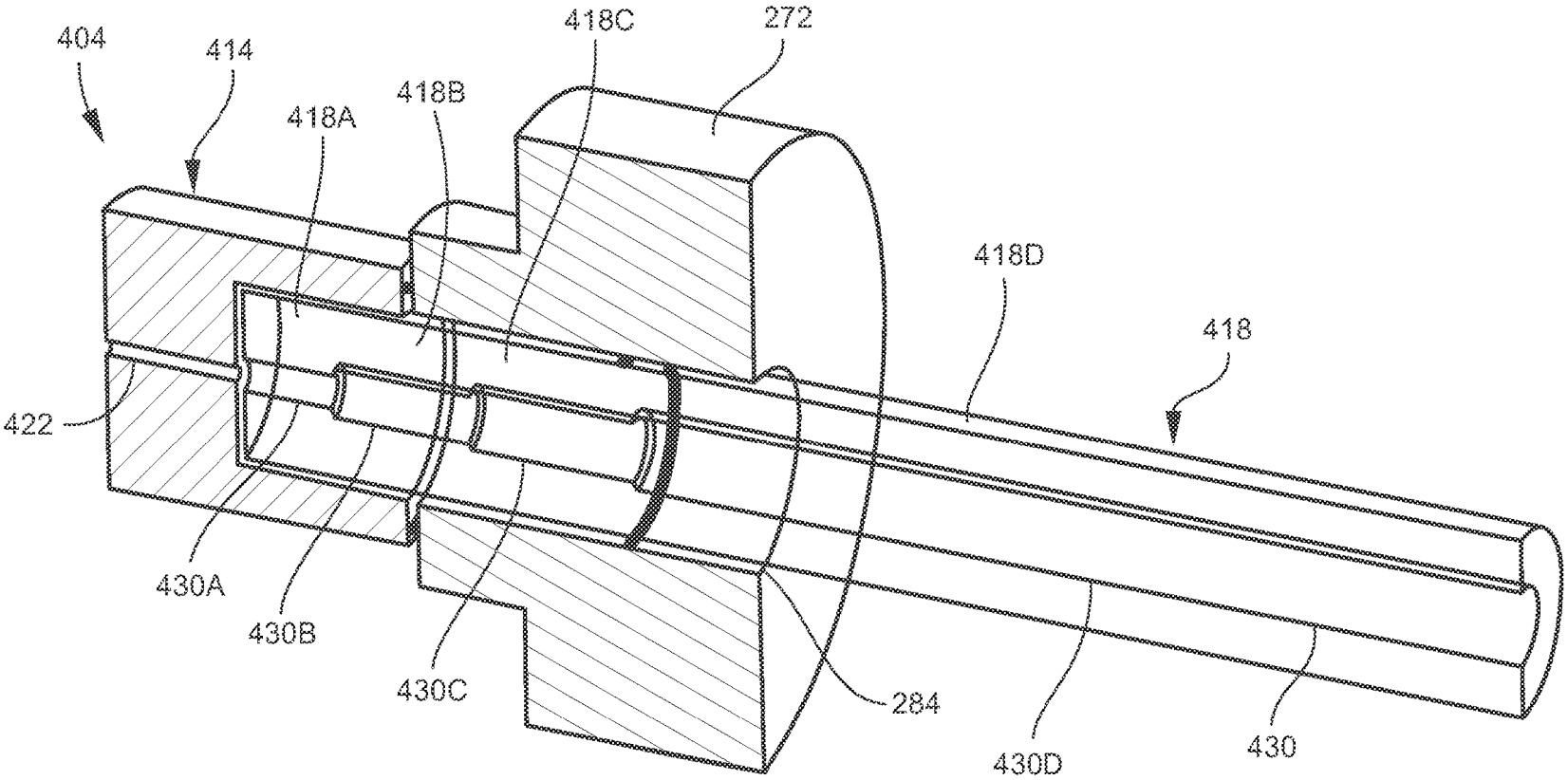
FIG. 4 is a cross-sectional schematic perspective view of an example of an ion transfer device according to another embodiment.

FIG. 4 is a cross-sectional schematic perspective view of an example of an ion transfer device 404 according to another embodiment. As in other embodiments, the ion transfer device 404 includes an ion inlet section 414 having a lumen 422 positioned adjacent to a main capillary section 418 having a capillary bore 430 communicating with the lumen 422, with the capillary bore 430 having a larger inside diameter than that of the lumen 422. In the present embodiment, the main capillary section 418 includes a plurality of distinct capillary tube sections or segments arranged in series along its axial length. The inside diameter of the capillary bore 430 successively increases from one capillary tube segment to another in the direction of the outlet end of the ion transfer device 404. For example, in the illustrated embodiment the main capillary section 418 includes a first capillary tube segment 418A having a first bore section 430A, a second capillary tube segment 418B having a second bore section 430B, a third capillary tube segment 418C having a third bore section 430C, and a fourth capillary tube segment 418D having a fourth bore section 430D. The inside diameter of the first bore section 430A is greater than that of the lumen 422, the inside diameter of the second bore section 430B is greater than that of the first bore section 430A, the inside diameter of the third bore section 430C is greater than that of the second bore section 430B, and the inside diameter of the fourth bore section 430D is greater than that of the third bore section 430C. In the present embodiment, the inside diameter of the capillary bore 430 is varied (increased) in a step-wise manner. Each step up in inside diameter may be considered as demarcating the interface between adjacent capillary tube segments 418A-418D.

The illustrated embodiment provides four capillary tube segments 418A-418D as one example. However, the number of capillary tube segments may be more or less than four in other embodiments. The number of capillary tube segments 418A-418D, the respective axial lengths of the capillary tube segments 418A-418D, and the respective inside diameters of the bore sections 430A-430D may be set as needed to achieve desired pressure drops, temperature, and flow rates along the length and at the exit of the main capillary section 418. The segmented configuration of the main capillary section 418 may enable finer control over such conditions. Specifically, the respective diameters and lengths of the capillary tube segments 418A-418D may be adjusted in a way that achieves control of gas velocity, pressure, and temperature in a desired way. One possible desired goal is to gradually reduce the pressure down the length of the multi-segment lumen so that the final exit into the vacuum system no longer results in a supersonic expansion at that location. This may have the benefit of reducing the tendency to form ionic clusters and may reduce turbulence in the first vacuum chamber.

The main capillary section 418 may be a monolithic structure in which each capillary tube segment (or section) 418A-418D transitions to an adjacent capillary tube segment (or section) 418A-418D in a continuous manner. In other embodiments, the main capillary section 418 may have a multi-segment configuration in which the capillary tube segments 418A-418D are positioned adjacent to each other but are physically separate segments. Adjacent capillary tube segments 418A-418D may directly abut each other. A fluid-sealed environment may be maintained by providing suitable sealing elements between the outer surfaces of the capillary tube segments 418A-418D and surrounding structures (e.g., the ion inlet section 414, the wall 272, a surrounding sleeve added to the assembly if needed, etc.). The multi-segment configuration may be desirable for practical considerations, such as to facilitate the realization of the varying inside diameter along the length of the main capillary section 418. In addition, separate capillary tube sections (segments) 418A-418D are able to be independently addressable by respective voltage sources. This may be desirable to enable finer control over the electric field render control over the electric field more independent from the flow conditions in the main capillary section 418.

In some embodiments, the ion inlet section 414 may be considered as being the first capillary tube segment or, stated differently, the first capillary tube segment in the series of tube segments provided by the ion transfer device 404 may serve as the ion inlet structure. The ion inlet section 414 (or the first capillary tube segment) may or may not have an end-cap configuration, and may or may not be removable.

In some embodiments, the lumen 422 of the ion inlet section 414 may include one or more transitions at which the inside diameter of the lumen 422 increases (e.g., steps up).

Figure 5:
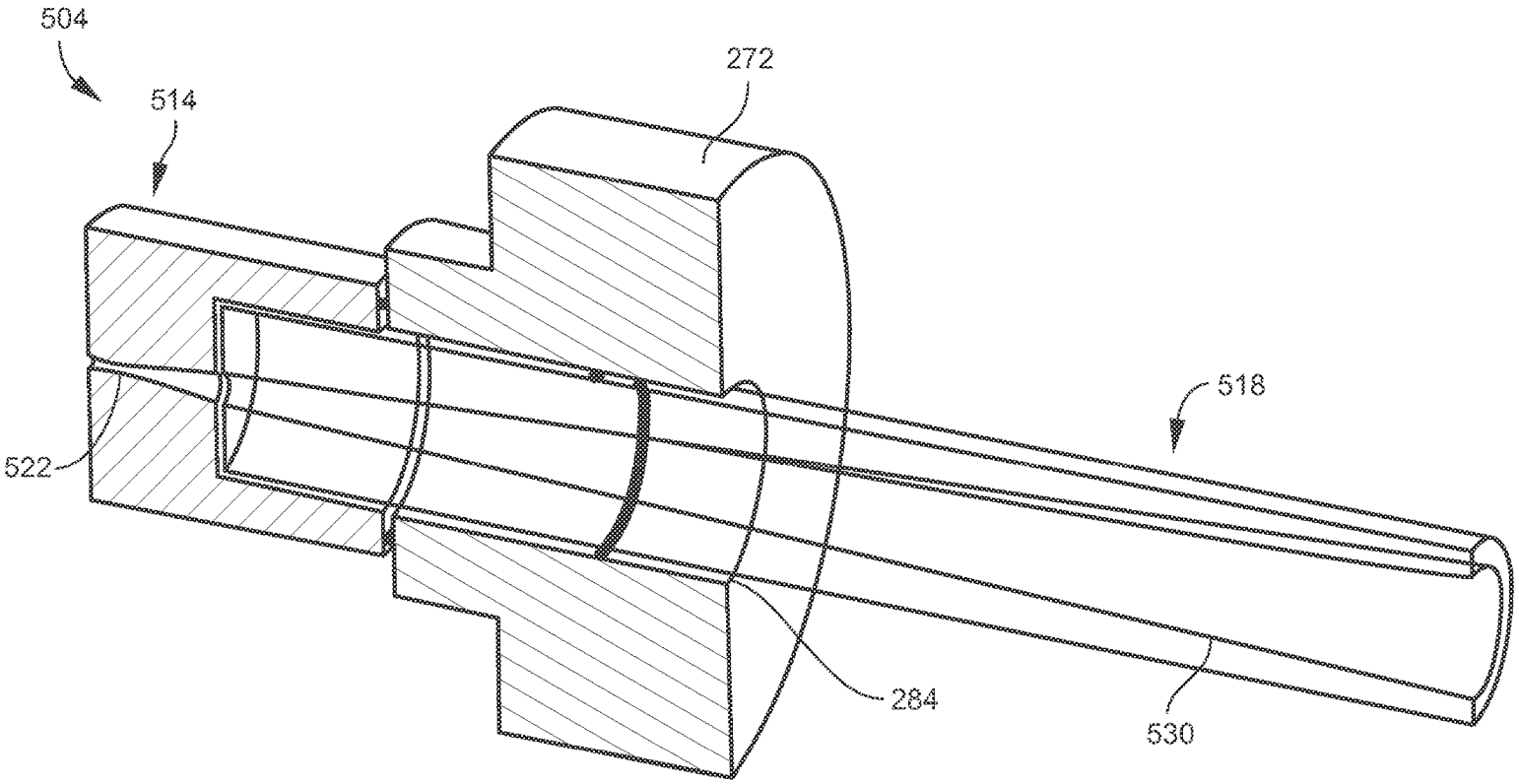
FIG. 5 is a cross-sectional schematic perspective view of an example of an ion transfer device according to another embodiment.

FIG. 5 is a cross-sectional schematic perspective view of an example of an ion transfer device 504 according to another embodiment. As in other embodiments, the ion transfer device 504 includes an ion inlet section 514 having a lumen 522 positioned adjacent to a main capillary section 518 having a capillary bore 530 communicating with the lumen 522, with the capillary bore 530 having a larger inside diameter than that of the lumen 522. Like the ion transfer device 404 of FIG. 4, in the present embodiment the inside diameter of the capillary bore 530 diverges (increases) in the axial direction toward the outlet end, such that the inside diameter of the capillary bore 530 is greater at the bore inlet than at the bore outlet. The ion transfer device 504 differs in that the capillary bore 530 diverges in a gradual (or smooth, or continuous) manner instead of in a step-wise manner. With this geometry, the pressure drop and gas flow rate may vary gradually along the axial length of the capillary bore 530 to achieve desired flow conditions at the outlet end. The gas flow may become supersonic in the capillary bore 530 and transition to subsonic flow upon exiting the ion transfer device 504. The divergence (or expansion) of the inside diameter may be based on a curve function such as, for example, a quadratic function.

In some embodiments and as illustrated, the lumen 522 of the ion inlet section 514 may also diverge in a gradual manner in the axial direction toward the capillary bore 530, such that inside diameter of the lumen 522 is greater at the lumen inlet than at the lumen outlet. Alternatively, the inside diameter of the lumen 522 may be constant as in other embodiments. In either case, the ion inlet section 514 achieves the initial pressure drop and conductance limit of the ion transfer device 504, and the diverging geometry of the capillary bore 530 smoothly adjusts the flow conditions to achieve desired exit conditions (e.g., Mach number, pressure, temperature, flow rate, etc.). In either case, the transition from the lumen outlet to the bore inlet may be in effect continuous, i.e. the diameter of the lumen outlet may be equal or substantially equal to the diameter of the lumen outlet, or the transition may be somewhat abrupt (similar to the embodiments of FIGS. 2 and 3).

In some embodiments and as illustrated, the lumen 522 may include a converging section that begins at the lumen inlet and which, after a short axial distance, transitions to a diverging section in a direction toward the lumen outlet. In this case, the lumen inside diameter has a minimum value at a point between the lumen inlet and the lumen outlet, which point is typically closer to the lumen inlet than to the lumen outlet. The initial converging section may be useful for increasing the amount of ions drawn into the lumen inlet.

As in the embodiment of FIG. 4, the main capillary section 518 may be a monolithic structure or may have a multi-segment configuration. Likewise, when segmented the ion inlet section 514 may be provided by the first capillary tube segment. Moreover, the ion inlet section 514 (or the first capillary tube segment) may or may not have an end-cap configuration, and may or may not be removable.

Figure 6:
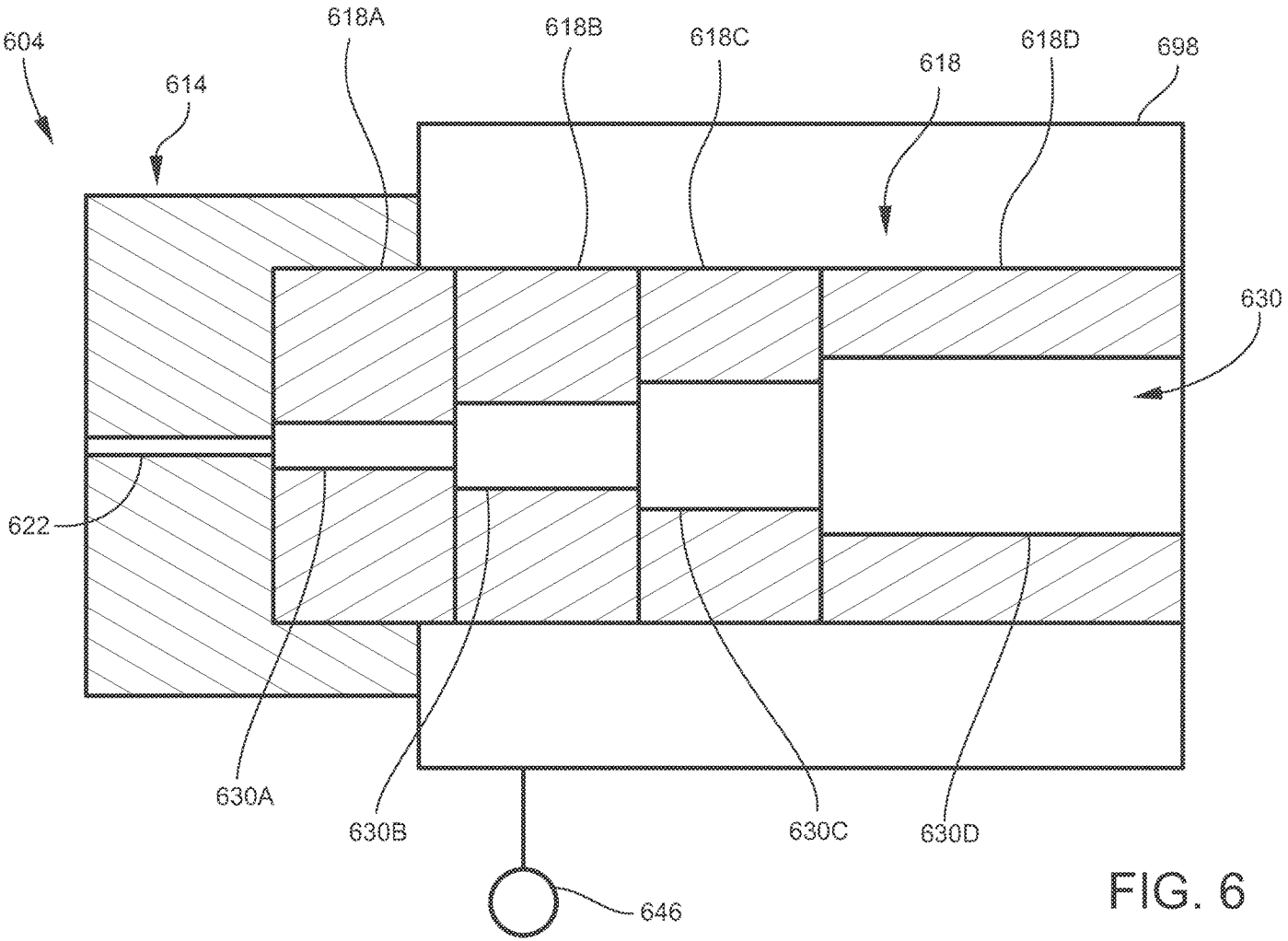
FIG. 6 is a cross-sectional schematic elevation view of an example of an ion transfer device according to another embodiment.

FIG. 6 is a cross-sectional schematic elevation view of an example of an ion transfer device 604 according to another embodiment. As in other embodiments, the ion transfer device 604 includes an ion inlet section 614 having a lumen 622 positioned adjacent to a main capillary section 618 having a capillary bore 630 communicating with the lumen 622, with the capillary bore 630 having a larger inside diameter than that of the lumen 622. In the present embodiment, the main capillary section 618 has a multi-segment configuration in which a plurality of physically distinct capillary tube segments 618A-618D are arranged in series along the axial length of the main capillary section 618. Adjacent capillary tube segments 618A-618D may directly abut each other. As in the embodiment of FIG. 4, the inside diameter of the capillary bore 630 successively increases in steps along the axial length in the direction of the outlet end of the ion transfer device 604, which in the present embodiment is implemented on a segment-by-segment basis. Thus as illustrated, the main capillary section 618 includes a first capillary tube segment 618A having a first bore section 630A, a second capillary tube segment 618B having a second bore section 630B, a third capillary tube segment 618C having a third bore section 630C, and a fourth capillary tube segment 618D having a fourth bore section 630D. The inside diameter of the first bore section 630A is greater than that of the lumen 622, the inside diameter of the second bore section 630B is greater than that of the first bore section 630A, the inside diameter of the third bore section 630C is greater than that of the second bore section 630B, and the inside diameter of the fourth bore section 630D is greater than that of the third bore section 630C.

In other embodiments, the inside diameter of the capillary bore 630 (or the inside diameters of both the capillary bore 630 and the lumen 622) may increase gradually, as in the embodiment of FIG. 5.

As also illustrated in FIG. 6, the main capillary section 618 (or both the main capillary section 618 and the ion inlet section 614) may be surrounded by a sleeve or other surrounding structure 698. The surrounding structure 698 may be configured to provide a fluid-tight sealing interface, with sealing elements positioned in gaps between adjacent structures as described above in conjunction with FIG. 2. Additionally or alternatively, all of part of the schematically illustrated surrounding structure 698 may be a heating device in thermal contact with the main capillary section 618 (or both the main capillary section 618 and the ion inlet section 614), as also described above. The heating device may include one or more heating elements (e.g., electrically resistive heating elements) powered by a suitable electrical power source 646, as appreciated by persons skilled in the art. In the present context, the term "thermal contact" means that the heating device (or some part thereof) is positioned appropriately so as to be able to transfer heat to the main capillary section 618 in an amount and rate effective for maintaining the fluid temperature at a desired level (typically under control of circuitry operatively associated with the power source 646).

Figure 7:
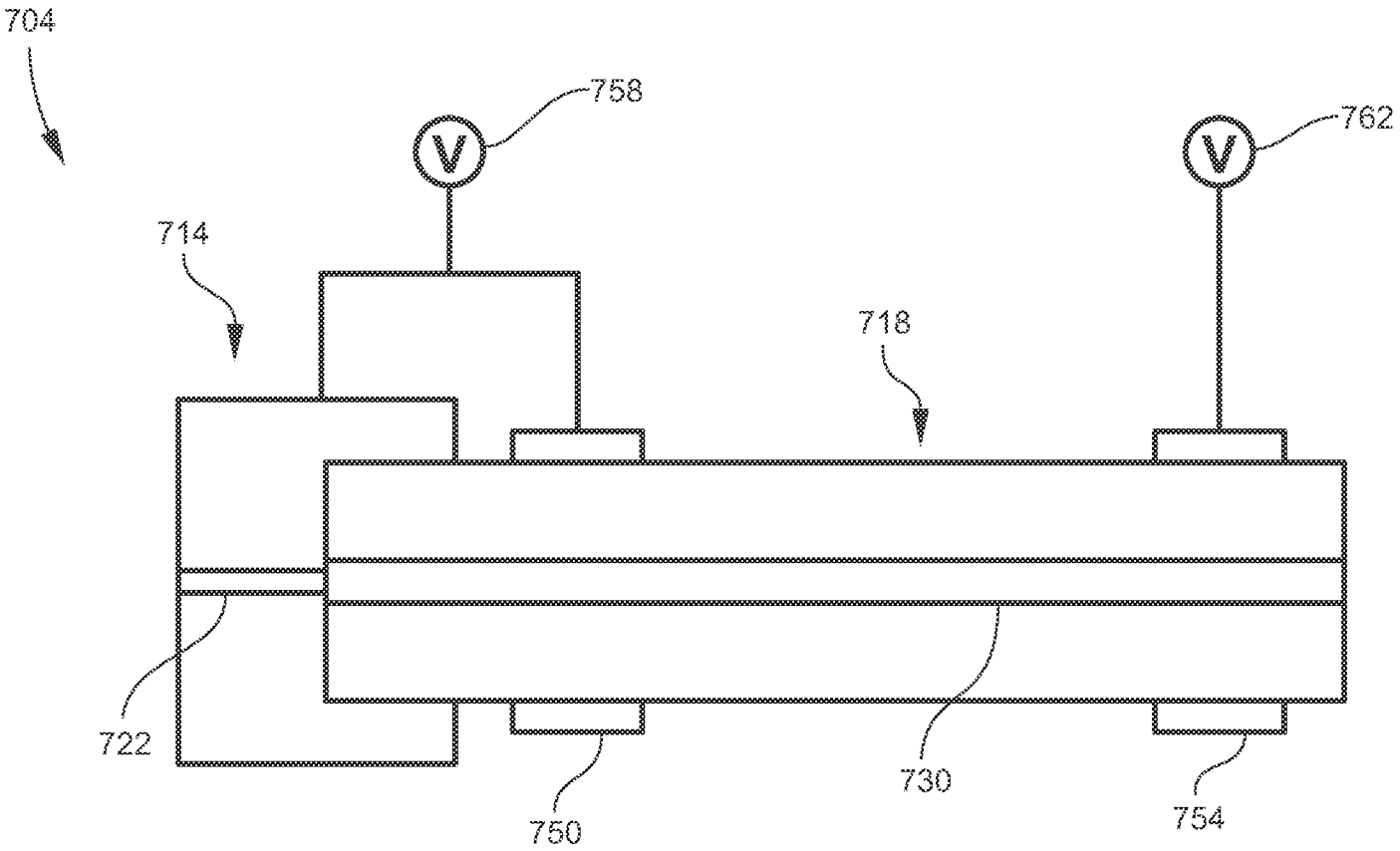
FIG. 7 is a cross-sectional schematic elevation view of an example of an ion transfer device according to another embodiment.

FIG. 7 is a cross-sectional schematic elevation view of an example of an ion transfer device 704 according to another embodiment. As in other embodiments, the ion transfer device 704 includes an ion inlet section 714 having a lumen 722 positioned adjacent to a main capillary section 718 having a capillary bore 730 communicating with the lumen 722, with the capillary bore 730 having a larger inside diameter than that of the lumen 722. In the present embodiment, a first conductive or resistive element 750 is disposed in or on the main capillary section 718 at or proximate to the inlet end of the main capillary section 718, and a second conductive or resistive element 754 at or proximate to the outlet end. The first conductive or resistive element 750 may be placed in electrical communication with a first voltage source 758, and the second conductive or resistive element 754 may be placed in electrical communication with a second voltage source 762. A relatively high voltage potential may be applied to the first conductive or resistive element 750, and a relatively low voltage level may be applied to the second conductive or resistive element 754 to generate a potential difference across the length of the main capillary section 718 and thereby aid in the transport of ions through the ion transfer device 704. The first conductive or resistive element 750 may be electrically interconnected with the ion inlet section 714. The potential on the ion inlet section 714 may be utilized to attract ions to the inlet of the ion transfer device 704.

Figure 8:
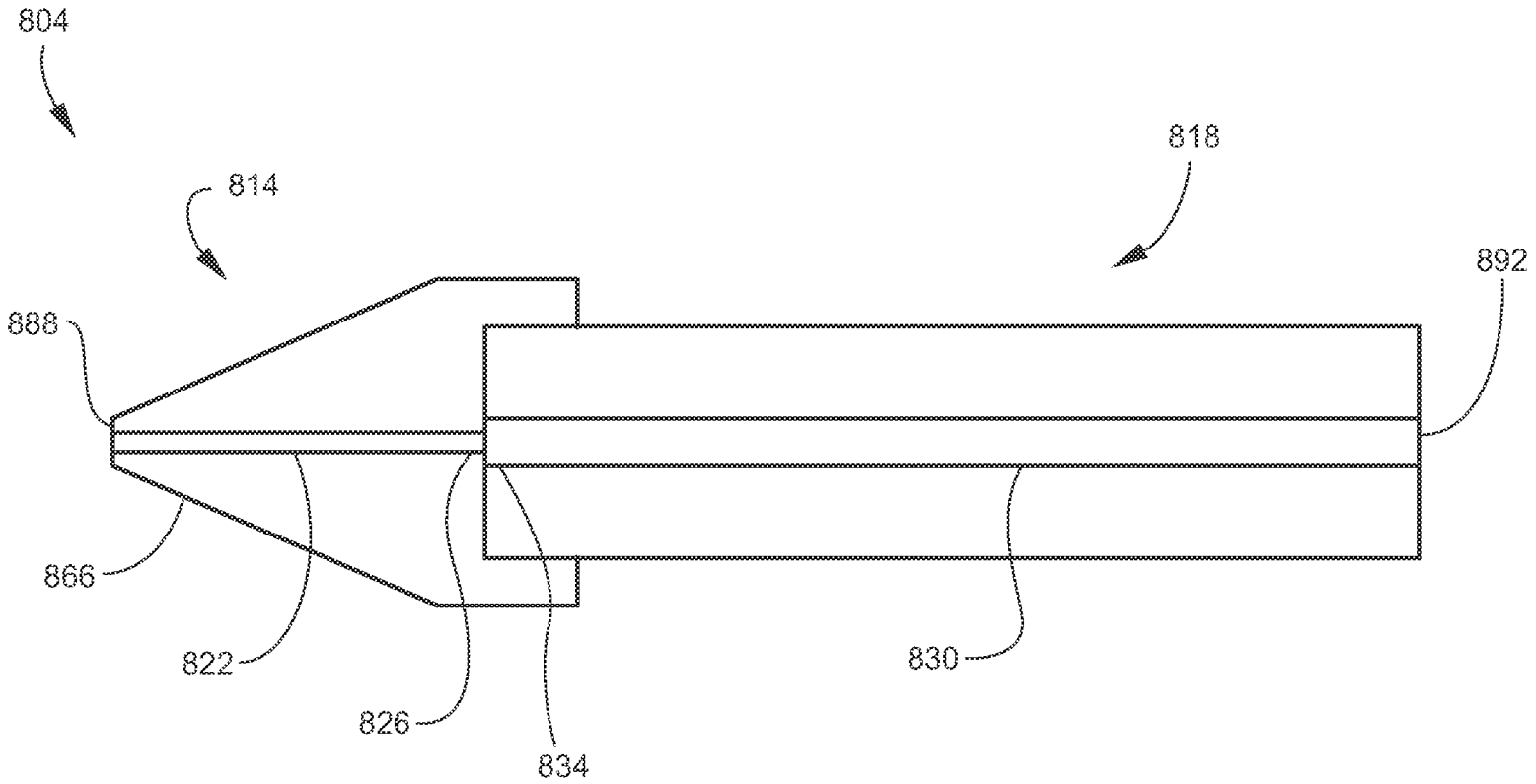
FIG. 8 is a cross-sectional schematic elevation view of an example of an ion transfer device according to another embodiment.

FIG. 8 is a cross-sectional schematic elevation view of an example of an ion transfer device 804 according to another embodiment. As in other embodiments, the ion transfer device 804 includes an ion inlet section 814 having a lumen 822 positioned adjacent to a main capillary section 818 having a capillary bore 830 communicating with the lumen 822, with the capillary bore 830 having a larger inside diameter than that of the lumen 822. The lumen 822 extends from a lumen inlet 888 serving as the entrance of the ion transfer device 804, and an internal lumen outlet 826. The capillary bore 830 extends from an internal bore inlet 834 communicating with the lumen outlet 826, and a bore outlet 892 serving as the exit of the ion transfer device 804. In the present embodiment, the ion inlet section 814 has a tapered geometry. That is, the ion inlet section 814 has a pointed shape in which an outside diameter of the ion inlet section 814 (i.e., the outside diameter of an outer surface 866 of the ion inlet section 814) increases in a direction toward the main capillary section 818. This tapered or pointed geometry may provide advantages, as described above. In the embodiment specifically illustrated in FIG. 8, the ion inlet section 814 (whether removable from or integral with the main capillary section 818) is configured such that the tapered portion is integral to the rest of the body constituting the ion inlet section 814. In another embodiment, however, the tapered portion may be a separate part that fits onto or around the (smaller) the ion inlet section 814.

Figure 9:
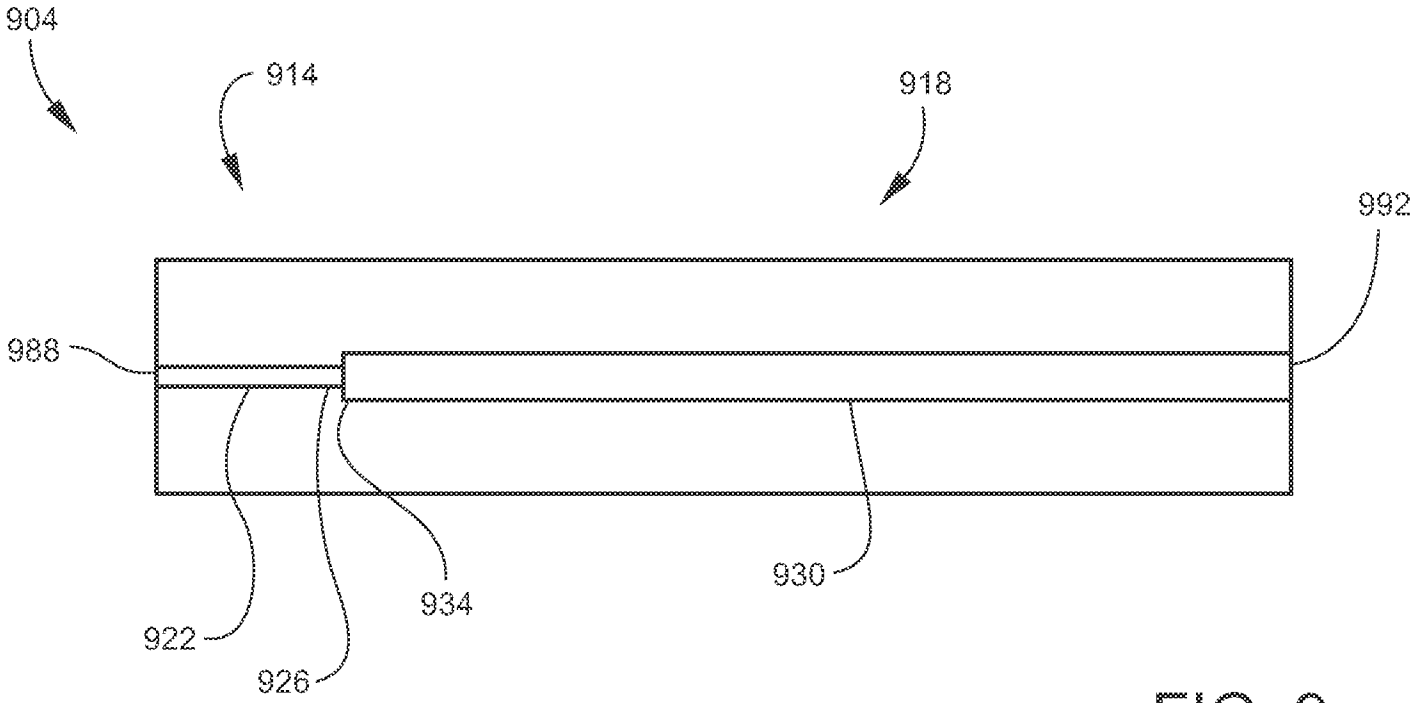
FIG. 9 is a cross-sectional schematic elevation view of an example of an ion transfer device according to another embodiment.

FIG. 9 is a cross-sectional schematic elevation view of an example of an ion transfer device 904 according to another embodiment. As in other embodiments, the ion transfer device 904 includes an ion inlet section 914 having a lumen 922 positioned adjacent to a main capillary section 918 having a capillary bore 930 communicating with the lumen 922, with the capillary bore 930 having a larger inside diameter than that of the lumen 922. The lumen 922 extends from a lumen inlet 988 serving as the entrance of the ion transfer device 904, and an internal lumen outlet 926. The capillary bore 930 extends from an internal bore inlet 934 communicating with the lumen outlet 926, and a bore outlet 992 serving as the exit of the ion transfer device 904. In the present embodiment, the ion transfer device 904 has a single-piece or monolithic configuration in which the ion inlet section 914 is integral or contiguous with the main capillary section 918 as described earlier in this disclosure. That is, the ion inlet section 914 and the main capillary section 918 are not physically separate components. In some embodiments and as illustrated, the interface or transition between the ion inlet section 914 and the main capillary section 918 (and thus also the lumen outlet 926 and the bore inlet 934) may be distinct, such as by being demarcated by a distinct change in inside diameter (e.g., the smaller inside diameter of the lumen 922 is stepped up to the larger inside diameter of the capillary bore 930). In other embodiments, the inside diameters of the lumen 922 and the capillary bore 930 may vary gradually such as shown in FIG. 5, and the change in inside diameter at the transition from the lumen 922 to the capillary bore 930 may be less abrupt than what is shown in FIG. 9. In this latter case, the ion inlet section 914 may be considered as being the inlet end portion or region of the single-piece ion transfer device 904. As in other embodiments, the axial lengths of the ion inlet section 914 and the main capillary section 918 and the geometries of the lumen 922 and the capillary bore 930 are configured to reduce contamination and optimize flow behavior through the ion transfer device 904.

Additional embodiments of an ion transfer device as disclosed herein may include a combination of features from two or more of the embodiments described above and illustrated in FIGS. 1-9.

The present disclosure also relates to an ion transfer system that includes an ion transfer device as disclosed herein. The ion transfer system may include a first chamber, a second chamber configured to be evacuated down to a pressure lower than a pressure of the first chamber, and a wall separating the first chamber and the second chamber. The wall includes an opening extending through its thickness. The ion transfer device is positioned at the wall in a fluid-sealed manner, with the ion inlet section and/or the main capillary section of the ion transfer device extending into or through the opening. The lumen inlet of the ion transfer device communicates with the first chamber, and the bore outlet of the ion transfer device communicates with the second chamber. FIG. 1 illustrates an example of an ion transfer system that includes a first chamber 128, a second chamber 140, and an ion transfer device 104 with an inlet 188 disposed in or facing the first chamber 128 and an outlet 192 disposed in or facing the second chamber 140.

The present disclosure further relates to an analytical instrument, particularly a mass spectrometry (MS) system, which includes an ion transfer system as disclosed herein. The MS system may include an atmospheric-pressure ionization device configured for producing ions in the first chamber, a vacuum housing enclosing the second chamber, and a mass analyzer disposed in the vacuum housing. FIG. 1 illustrates an example of an MS system 100, which is described in detail above.

Exemplary Embodiments

Exemplary embodiments provided in accordance with the presently disclosed subject matter include, but are not limited to, the following:

1. An ion transfer device, comprising: an ion inlet section comprising a lumen having a lumen inside diameter, the lumen comprising a lumen inlet and a lumen outlet; a main capillary section comprising a bore having a bore inside diameter, the bore comprising a bore inlet and a bore outlet, wherein: the ion inlet section and the main capillary section are positioned adjacent to each other such that the lumen outlet communicates with the bore inlet in a fluid-sealed manner, and the ion inlet section and the main capillary section define an ion transfer path running from the lumen inlet to the bore outlet; and the lumen inside diameter is less than the bore inside diameter.

2. The ion transfer device of embodiment 1, wherein the lumen inside diameter is in a range from 0.25 mm to 0.6 mm, and the bore inside diameter is in a range from 0.5 mm to 1.0 mm.

3. The ion transfer device of embodiment 1 or 2, wherein the lumen has a configuration selected from the group consisting of: the lumen inside diameter is constant; the lumen diverges in a gradual manner, such that the lumen inside diameter is greater at the lumen outlet than at the lumen inlet; the lumen diverges in a step-wise manner, such that the lumen inside diameter is greater at the lumen outlet than at the lumen inlet; and the lumen comprises a converging section that transitions to a diverging section in a direction toward the lumen outlet, such that the lumen inside diameter has a minimum value at a point between the lumen inlet and the lumen outlet.

4. The ion transfer device of any of the preceding embodiments, wherein the bore has a configuration selected from the group consisting of: the bore inside diameter is constant; the bore diverges in a gradual manner, such that the bore inside diameter is greater at the bore outlet than at the bore inlet; and the bore diverges in a step-wise manner, such that the bore inside diameter is greater at the bore outlet than at the bore inlet.

5. The ion transfer device of any of the preceding embodiments, wherein the main capillary section comprises a plurality of tube segments serially positioned adjacent to each other.

6. The ion transfer device of any of the preceding embodiments, wherein the ion inlet section and the main capillary section have respective lengths along a longitudinal axis, and the length of the ion inlet section is less than the length of main capillary section.

7. The ion transfer device of any of the preceding embodiments, wherein the ion inlet section is composed of an electrically conductive material.

8. The ion transfer device of embodiment 7, wherein the main capillary section has a composition selected from the group consisting of an electrically conductive material, an electrically insulating material, an electrically insulating material with bulk electrical resistance, and an electrically insulating material with surface electrical resistance.

9. The ion transfer device of any of the preceding embodiments, wherein the main capillary section comprises a first resistive element proximate to the bore inlet and a second resistive element proximate to the bore outlet, such that the first resistive element and the second resistive element are independently addressable by respective voltage sources.

10. The ion transfer device of embodiment 9, wherein the first resistive element is electrically interconnected to the ion inlet section.

11. The ion transfer device of any of the preceding embodiments, comprising a heating device positioned in thermal contact with the main capillary section.

12. The ion transfer device of any of the preceding embodiments, comprising a wall having a thickness, wherein the wall comprises an opening extending through the thickness, and at least one of the ion inlet section and the main capillary section is mounted to the wall.

13. The ion transfer device of embodiment 12, comprising a sealing interface selected from the group consisting of: a gap in the opening, between the main capillary section and the wall, and a sealing element disposed in the gap; a gap between the ion inlet section and the main capillary section, and a sealing element disposed in the gap; and both of the foregoing.

14. The ion transfer device of any of the preceding embodiments, wherein the ion inlet section has a pointed shape in which an outside diameter of the ion inlet section increases in a direction toward the main capillary section.

15. The ion transfer device of any of the preceding embodiments, wherein the ion inlet section comprises a cap removably mounted to the main capillary section, and the cap comprises the lumen.

16. The ion transfer device of embodiment 15, wherein the cap comprises a recess communicating with the lumen outlet, and the main capillary section extends into the recess.

17. An ion transfer system, comprising: a first chamber; a second chamber configured to be evacuated down to a pressure lower than a pressure of the first chamber; a wall separating the first chamber and the second chamber, the wall having a thickness and comprises an opening extending through the thickness; and the ion transfer device of any of the preceding embodiments, wherein the ion transfer device is positioned at the wall in a fluid-sealed manner, at least one of the ion inlet section and the main capillary section extends into the opening, the lumen inlet communicates with the first chamber, and the bore outlet communicates with the second chamber.

18. The ion transfer system of embodiment 17, wherein the second chamber comprises a port configured for communication with a vacuum pump.

19. A mass spectrometry (MS) system, comprising: the ion transfer system of embodiment 17 or 18; an atmospheric-pressure ionization device configured for producing ions in the first chamber; a vacuum housing enclosing the second chamber; and a mass analyzer disposed in the vacuum housing.

20. A method for transferring ions, the method comprising: creating a pressure differential between a first chamber and a second chamber such that the second chamber has a pressure less than a pressure of the first chamber, wherein: the first chamber and the second chamber are separated by a wall; and an ion transfer device extends through the wall and comprises an ion inlet section and a main capillary section; the ion inlet section comprises an inlet leading to a lumen; the main capillary section comprises a bore communicating with the lumen and leading to an outlet; and the lumen has a lumen diameter and the bore has a bore diameter greater than the lumen diameter; producing ions in the first chamber; drawing the ions into the inlet; transporting the ions from the inlet through the lumen and into the bore, and through the bore to the outlet; and emitting the ions from the outlet into the second chamber.

It will be understood that terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. An ion transfer device, comprising:

an ion inlet section comprising a lumen having a lumen inside diameter, the lumen comprising a lumen inlet;

a main capillary section comprising a bore having a bore inside diameter, the bore comprising a bore outlet, wherein:

the ion inlet section and the main capillary section are positioned such that the lumen communicates with the bore, and the ion inlet section and the main capillary section define an ion transfer path running from the lumen inlet to the bore outlet; and the ion inlet section and the main capillary section are configured such that the lumen inside diameter has an average value that is less than an average value of the bore inside diameter, and a difference between the average value of the lumen inside diameter and the average value of the bore inside diameter is large enough to cause sonic or supersonic gas flow in the ion inlet section or in the main capillary section immediately downstream from the ion inlet section, and the gas flow is not supersonic at the bore outlet.

2. The ion transfer device of claim 1, wherein the lumen inside diameter is in a range from 0.25 mm to 0.6 mm, and the bore inside diameter is in a range from 0.5 mm to 1.0 mm.

3. The ion transfer device of claim 1, wherein the lumen has a configuration selected from the group consisting of:

the lumen inside diameter is constant;

the lumen diverges in a gradual manner, in a direction toward the main capillary section;

the lumen diverges in a step-wise manner, in a direction toward the main capillary section; and the lumen comprises a converging section that transitions to a diverging section in a direction toward the main capillary section, such that the lumen inside diameter has a minimum value at a point between the lumen inlet and the main capillary section.

4. The ion transfer device of claim 1, wherein the bore has a configuration selected from the group consisting of:

the bore inside diameter is constant;

the bore diverges in a gradual manner, in a direction toward the bore outlet; and the bore diverges in a step-wise manner, in a direction toward the bore outlet.

5. The ion transfer device of claim 1, wherein the main capillary section comprises a plurality of tube segments serially positioned adjacent to each other.

6. The ion transfer device of claim 1, wherein the ion inlet section and the main capillary section have respective lengths along a longitudinal axis, and the length of the ion inlet section is less than the length of main capillary section.

7. The ion transfer device of claim 1, wherein the ion inlet section is composed of an electrically conductive material.

8. The ion transfer device of claim 7, wherein the main capillary section has a composition selected from the group consisting of an electrically conductive material, an electrically insulating material, an electrically insulating material with bulk electrical resistance, and an electrically insulating material with surface electrical resistance.

9. The ion transfer device of claim 1, wherein the main capillary section comprises a first resistive element proximate to the bore inlet and a second resistive element proximate to the bore outlet, such that the first resistive element and the second resistive element are independently addressable by respective voltage sources.

10. The ion transfer device of claim 9, wherein the first resistive element is electrically interconnected to the ion inlet section.

11. The ion transfer device of claim 1, comprising a wall having a thickness, wherein the wall comprises an opening extending through the thickness, and at least one of the ion inlet section and the main capillary section is mounted to the wall.

12. The ion transfer device of claim 11, comprising a sealing interface selected from the group consisting of:

a gap in the opening, between the main capillary section and the wall, and a sealing element disposed in the gap;

a gap between the ion inlet section and the main capillary section, and a sealing element disposed in the gap; and both of the foregoing.

13. The ion transfer device of claim 1, wherein the ion inlet section has a pointed shape in which an outside diameter of the ion inlet section increases in a direction toward the main capillary section.

14. The ion transfer device of claim 1, wherein the ion inlet section is integral with the main capillary section.

15. The ion transfer device of claim 1, wherein the ion inlet section comprises a cap removably mounted to the main capillary section, and the cap comprises the lumen.

16. The ion transfer device of claim 15, wherein the cap comprises a recess communicating with the lumen outlet, and the main capillary section extends into the recess.

17. An ion transfer system, comprising:

a first chamber;

a second chamber configured to be evacuated down to a pressure lower than a pressure of the first chamber;

a wall separating the first chamber and the second chamber, the wall having a thickness and comprises an opening extending through the thickness; and the ion transfer device of claim 1, wherein the ion transfer device is positioned at the wall in a fluid-sealed manner, at least one of the ion inlet section and the main capillary section extends into the opening, the lumen inlet communicates with the first chamber, and the bore outlet communicates with the second chamber.

18. The ion transfer system of claim 17, wherein the second chamber comprises a port configured for communication with a vacuum pump.

19. A mass spectrometry (MS) system, comprising:

the ion transfer system of claim 17;

an atmospheric-pressure ionization device configured for producing ions in the first chamber;

a vacuum housing enclosing the second chamber; and a mass analyzer disposed in the vacuum housing.

20. A method for transferring ions, the method comprising:

creating a pressure differential between a first chamber and a second chamber such that the second chamber has a pressure less than a pressure of the first chamber, wherein:

the first chamber and the second chamber are separated by a wall; and an ion transfer device extends through the wall and comprises an ion inlet section and a main capillary section;

the ion inlet section comprises an inlet leading to a lumen;

the main capillary section comprises a bore communicating with the lumen and leading to an outlet; and the lumen has a lumen diameter and the bore has a bore diameter greater than the lumen diameter;

drawing ions and gas from the first chamber into the inlet;

transporting the ions and gas from the inlet through the lumen and into the bore, and through the bore to the outlet, wherein the gas reaches sonic or supersonic gas flow in the ion inlet section or in the main capillary section immediately downstream from the ion inlet section; and emitting the ions from the outlet into the second chamber, wherein the gas flow is not supersonic at the outlet.

* * * * *